US005425295A

United States Patent [19]

Peters et al.

[11] Patent Number: 5,425,295

[45] Date of Patent: Jun. 20, 1995

[54] SHEET MATERIAL CUTTER HAVING PIVOTABLE HEAD

[75] Inventors: Alan R. Peters, Milford; Vincent T. Kozyrski, Plainville, both of Conn.

[73] Assignee: The Fletcher-Terry Company, Farmington, Conn.

[21] Appl. No.: 146,959

[22] Filed: Nov. 3, 1993

Related U.S. Application Data

[63] Continuation-in-part of Ser. No. 888,201, May 26, 1992, Pat. No. 5,269,212.

[51] Int. Cl.[6] ..... B26D 7/26

[52] U.S. Cl. ..... 83/522.24; 83/578; 83/581; 83/614

[58] Field of Search ..... 83/522.24, 455, 614, 83/578, 635, 581

[56] References Cited

U.S. PATENT DOCUMENTS

| | | | |
|---|---|---|---|
| 1,250,538 | 12/1917 | Williams . | |
| 2,198,333 | 4/1940 | Freeman | 83/522.24 |
| 2,633,196 | 3/1953 | Taran | 164/73 |
| 2,646,120 | 7/1953 | Pietrafesa | 83/522.24 |
| 2,924,010 | 2/1960 | Umholtz | 30/293 |
| 3,108,349 | 10/1963 | Takacs | 25/108 |
| 3,964,360 | 6/1976 | Schwartz | 83/464 |
| 4,064,626 | 12/1977 | Meshulam et al. | 30/287 |
| 4,262,419 | 4/1981 | Pierce | 30/293 |
| 4,413,542 | 11/1983 | Rompel | 83/455 |
| 4,685,366 | 8/1987 | Beder | 83/455 |
| 4,798,112 | 1/1989 | Kozyrski et al. | 83/455 |
| 4,831,739 | 5/1989 | Davidson | 33/427 |
| 4,986,156 | 1/1991 | McGinnis | 83/467.1 |
| 5,269,212 | 12/1993 | Peters et al. | 83/455 |

OTHER PUBLICATIONS

"Brookstone"-p. 55-Peterboro, N.H.

"ALTO Model 45 Mat Cutter"-United Manufacturer's Supply Catalogue.

*Primary Examiner*—Kenneth E. Peterson

*Attorney, Agent, or Firm*—Ira S. Dorman

[57] ABSTRACT

A push-pull DIY cutter for sheet material, such as mat and foam board, utilizes a blade-mounting handle that is pivotable from a null position in both of two opposite directions, so as to alternatively bring into operative position a blade element spaced to either side of the null position center line. The blade is mounted for lateral shifting, so as to cause the elements on its opposite ends to protrude to a greater or lesser extent from either side of the cutting head. Indicia are provided along the lower boundary of the head to facilitate adjustment of the blade for optimal protrusion of the blade element that is to be utilized in any given instance.

8 Claims, 5 Drawing Sheets

10
5
16
40
14
6
32
20
26
41
28
29
62
79
74"
72
38
104
91
12
154
2
86
102
90
88
7
6
5
4
3
2
1

94
158
154
156

SHEET MATERIAL CUTTER HAVING PIVOTABLE HEAD

CROSS-REFERENCE TO RELATED APPLICATION

This application is a continuation-in-part of application for Letters Patent Ser. No. 07/888,201, filed May 26, 1992 and now issued as U.S. Pat. No. 5,269,212.

BACKGROUND OF THE INVENTION

Mat boards with cut sight openings are commonly used for framing photographs, pictures and the like. Numerous forms of manual devices and machines are disclosed in the art, and are commercially available in both professional and also "DIY" (do-it-yourself) models, for cutting both the outside periphery of such mats (normally done with a "straight" cut, at a perpendicular angle) as well as the sight opening (normally done with a "bevel" cut, at an acute angle).

Exemplary apparatus is shown in the following U.S. Pat. Nos. Williams 1,250,538, issued Dec. 18, 1917, Umholtz 2,924,010, issued Feb. 9, 1960, Meshulam et al 4,064,626, issued Dec. 27, 1977, Pierce 4,262,419, issued Apr. 21, 1981, Beder 4,685,366, issued Aug. 11, 1987, and McGinnis 4,986,156, issued Jan. 22, 1991; a system generally more sophisticated than the foregoing is disclosed by Kozyrski et al in U.S. Pat. No. 4,798,112, issued Jan. 17, 1989. Davidson U.S. Pat. No. 4,831,739, issued May 23, 1989, provides an adjustable template device, for framing and cutting sheet material, in which resilient pins engage lines of detents so as to retard relative sliding movement of adjacent members.

Despite the foregoing, a need remains for a manual cutter which is capable of operating in both of two opposite directions, which affords a wide degree of flexibility of use, and which is, at the same time, of relatively simple and inexpensive construction and hence particularly well adapted for promotion and sale as a DIY cutter.

SUMMARY OF THE INVENTION

Accordingly, it is the broad object of the present invention to provide a novel manual cutter that enables cutting of sheet material workpieces in both of two opposite directions, that affords an advantageous degree of flexibility of use, and that is, at the same time, of relatively simple and inexpensive construction.

A more specific object of the invention is to provide such a cutter in which the depth of cutting is readily and effectively adjusted.

It has now been found that the foregoing and related objects of the invention are attained by the provision of a cutter comprising a base having an upstanding wall portion, and a cutting head mounted thereon. The head includes mounting structure having upper and lower opposite end portions, handle means on the upper end portion, and blade-holding means on the lower end portion; it is mounted for pivotable movement in opposite directions relative to a central axis of the upstanding wall portion. The blade-holding means has two edge elements spaced to the opposite sides of a longitudinal axis of the mounting structure, which axis extends through the axis of pivoting. Each edge element has a generally upward incline, taken with reference to the longitudinal axis (in vertical orientation), and defines a portion of a lower boundary of the blade-holding means. The latter is constructed to secure at least a single blade on the head, which blade is of such form as to provide two operative blade elements for protrusion beyond the edge elements of the holding means; positioning indicia extends along the edge elements. The mounting means constrains the blade to displacement along a transverse lateral axis, which displacement varies the protrusion of the blade elements beyond the edge elements, the extent of which is indicated by reference to the indicia on the blade-holding means.

Normally, the edge elements on the blade-holding means will be substantially rectilinear, and the lower boundary thereof will be symmetrical with reference to the longitudinal axis of the mounting structure. The blade-positioning indicia will advantageously comprise a series of marks that are equidistantly spaced from one another along each of the edge elements.

The means for mounting utilized on the cutter will preferably comprise at least one slot formed in the blade-holding means and extending on the lateral axis, in which case the cutter will include a member that has a shaft extending through the slot and is displaceable therealong. Most desirably, the blade-holding means will comprise parts that cooperate to clamp the blade in position, at least one of which parts has an element that extends toward the other and effectively defines a laterally extending blade-abutment element at an upwardly-spaced location. Usually, the mounting structure will be provided by the innermost part, and both parts will be formed with aligned, laterally extending slots. In these embodiments the cutter will include a fastener that extends through the slots, and is displaceable therealong, for securing the parts in a clamping relationship.

DETAILED DESCRIPTION OF THE ILLUSTRATED EMBODIMENTS

Figures 1, 2:
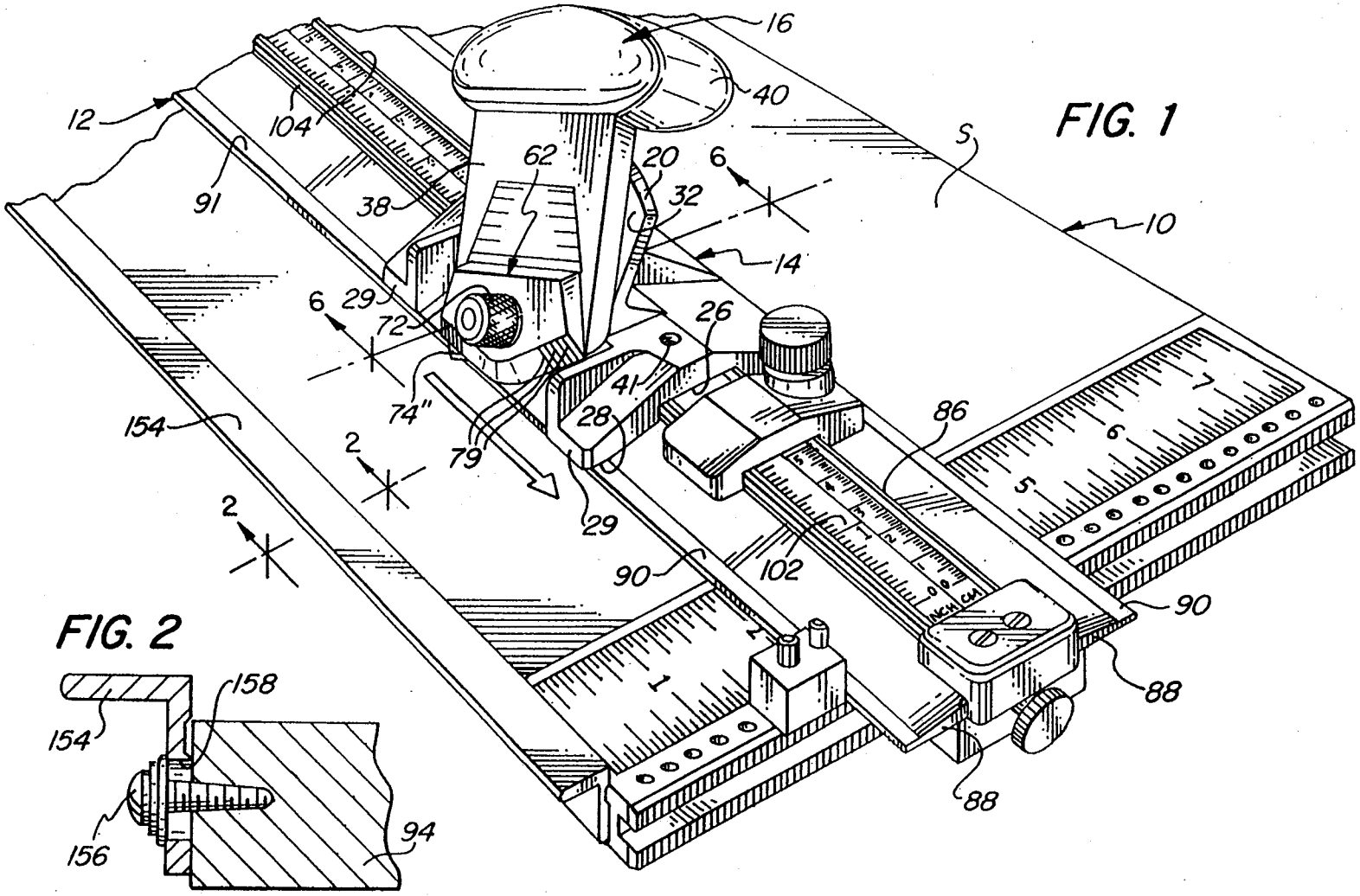
FIG. 1 is a fragmentary perspective view showing a system in which is employed a cutter embodying the present invention.
FIG. 2 is a fragmentary sectional view taken along line 2—2 of FIG. 1 and drawn to a scale enlarged therefrom.
Figure 3:
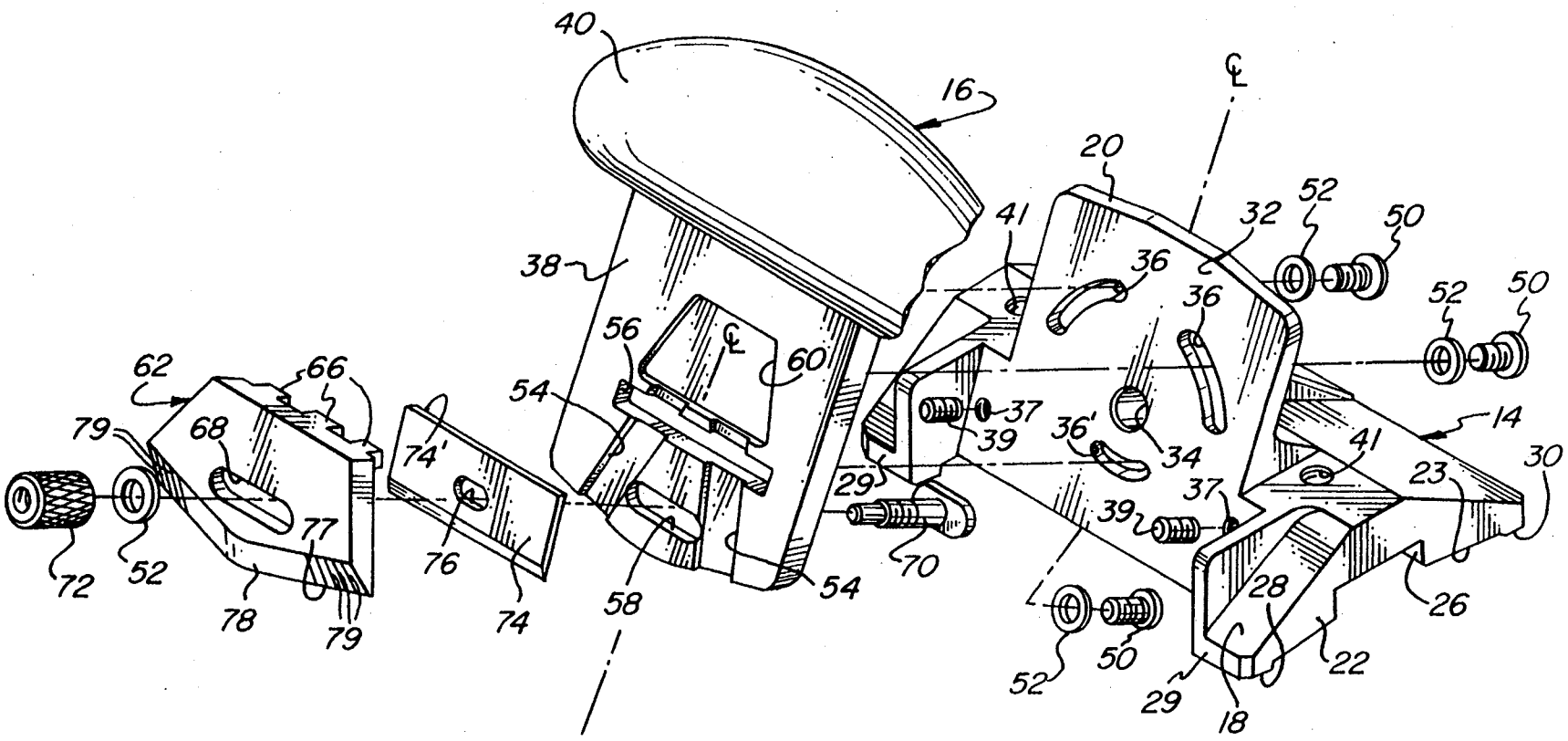
FIG. 3 is an exploded perspective view of a cutter embodying the invention.
Figure 4:
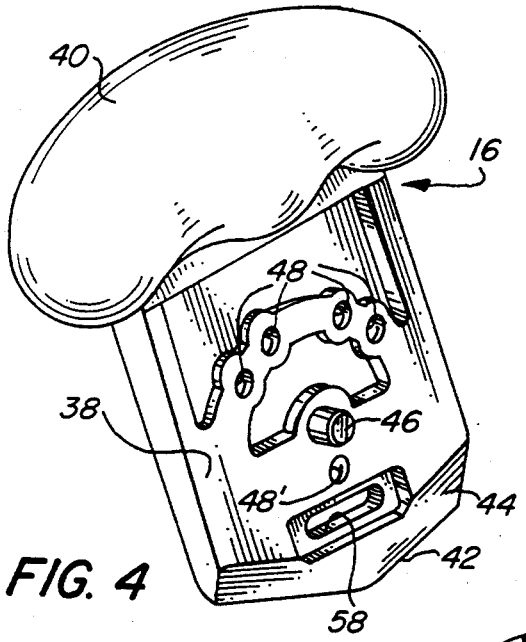
FIG. 4 is a perspective view showing the handle member comprising a component of the cutting head utilized in the cutter of FIGS. 1 and 3.

The drawings illustrate a system for cutting sheet material "S", and include a workpiece-supporting base assembly generally designated by the numeral 10, a clamping bar assembly generally designated by the numeral 12, and a cutter including a base and a head assembly, generally designated respectively by the numerals 14 and 16. The cutter base 14 comprises a hollow elongate body 18, of generally triangular cross section, including opposite end walls 22 and internal walls 24 (only one of each of which is visible), the walls 22, 24 being upwardly indented by a rectangular notch 26 so as to effectively define along the length of the body 18 a downwardly opening channel of effectively uniform, rectangular cross section. The lower edges 23 of walls 22, 24 decline from adjacent the indentations 26 in both directions toward the opposite outer margins, at which are formed underlying bearing surfaces 28 and 30 extending longitudinally therealong. It will be noted that the lower portion of the body 18 is substantially symmetric to the opposite sides of a vertical plane (in the normal operating position of the cutter) extending through the center of the channel (i.e., it is symmetric in planes to which the axis of the channel is normal), as best seen in FIG. 6.

The upstanding wall 20 on the base 18 has a flat forward contact surface 32, through which extends a central aperture 34; arcuate slots 36, 36' are formed about the aperture 34, and threaded holes 37 extend therethrough for threadably engaging set screws 39. The set screws bear upon tabs (not visible) formed within the base, which in turn bear upon the supporting track for varying the pressure applied thereagainst. A pair of threaded apertures 41 extend downwardly through the shoulders formed on the body 18, adjacent the opposite ends of the upstanding wall 20, for a purpose that is not germane to the present invention.

The head assembly 16 includes a flat and relatively wide supporting arm 38, which has a bulbous handle portion 40 on its upper end and a V-shaped edge 42, with a beveled marginal portion 44, defining its lower boundary. A cylindrical stub 46 extends rearwardly from the arm 38, and four threaded holes 48 are formed thereinto in an arcuate array, centered with reference to the stub 46.

Figure 6:
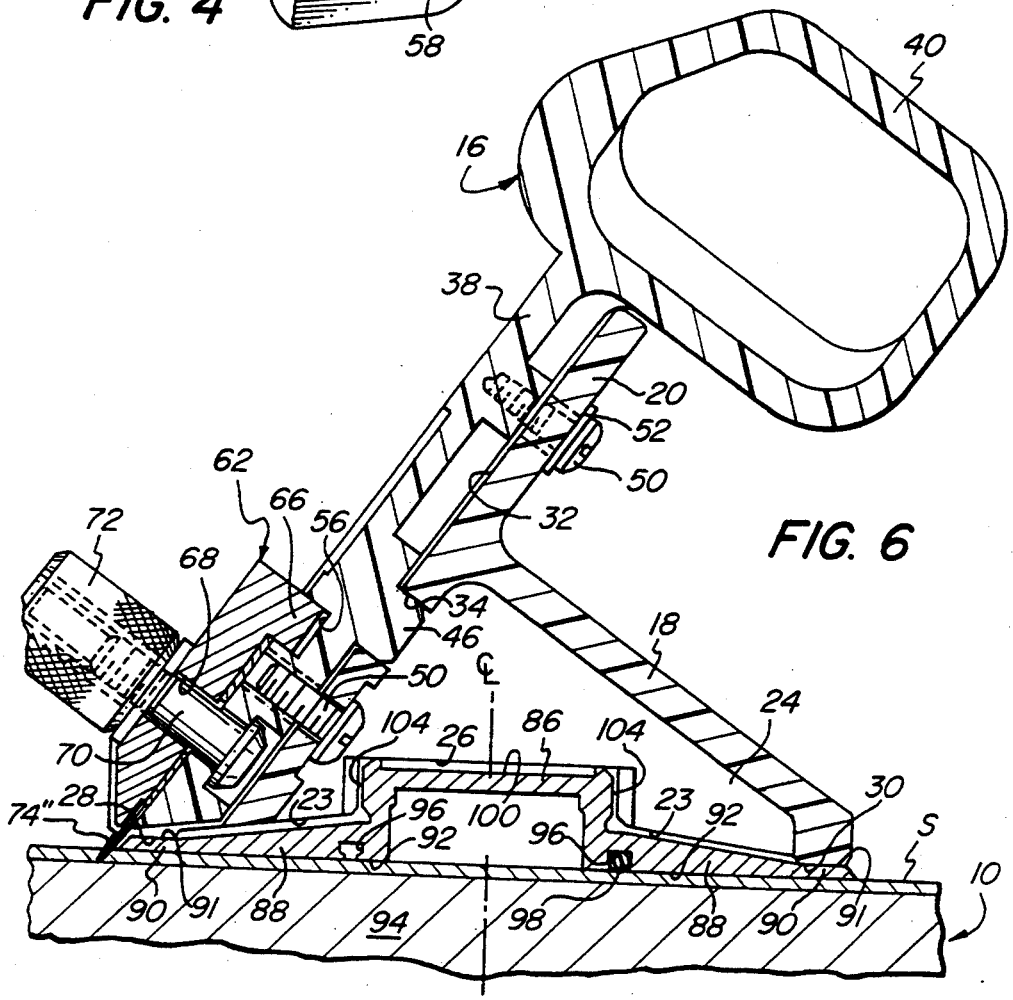
FIG. 6 is a fragmentary sectional view taken along line 6—6 of FIG. 1 and drawn to an enlarged scale.

As can be seen in FIG. 6, the head assembly 16 is pivotably mounted on the base 14 by engagement of the stub 46 in the central aperture 34 of the upstanding wall 20; the parts are secured by three screws 50, which pass through washers 52 and thereafter through the slots 36, 36' and into the threaded holes 48, 48'. It will be appreciated only two of the holes 48 (normally, the outermost ones) will receive screws 50, the others being employed to limit the degree of pivotable movement of the head, if so desired. The front face of the supporting arm 38 is formed with two upwardly convergent rectilinear channels 54, a laterally extending elongate cavity 56, a slot 58 therebelow, and a shallow trapezoidal recess 60 thereabove.

Figure 5:
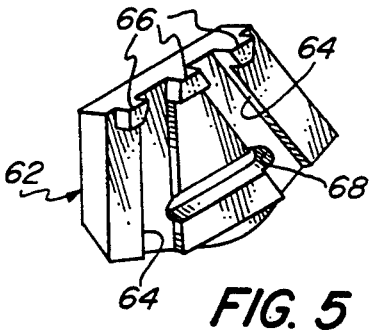
FIG. 5 is a perspective view showing the cover or clamping piece utilized in cooperation with the handle member of the cutting head.
Figure 7:
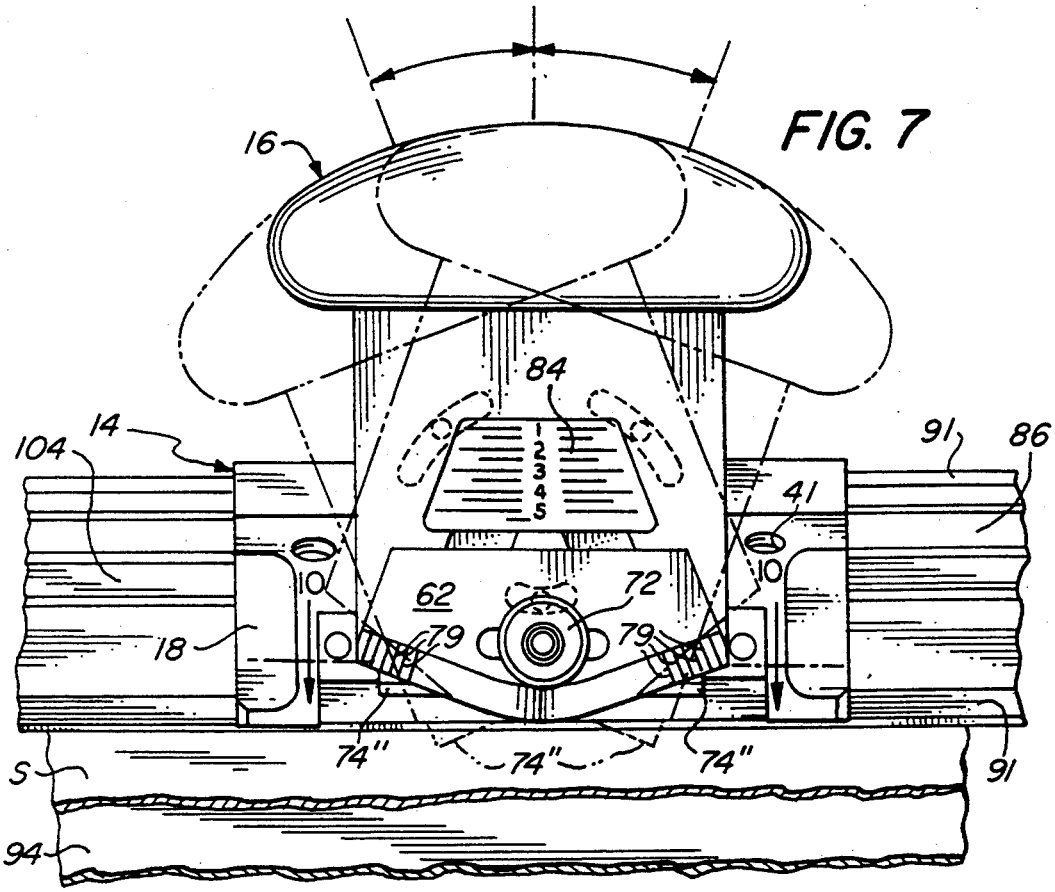
FIG. 7 is a fragmentary front elevational view of the system of FIG. 1, showing (in full line) the cutting head in its null position, and showing (in phantom line) the head pivoted for operation in both opposite directions from the null position.

The cutter assembly also includes a clamping piece, generally designated by the numeral 62. The rearward or innermost face of the clamping piece is, as shown in FIG. 5, formed with upwardly convergent channels 64, and an elongate, laterally extending slot 68; with the clamping piece 62 and arm 38 in assembly, as illustrated, the channels 54, 64 cooperate with one another to define open-ended passages. A stud 70, having an enlarged, straight-sided oval head, extends through the aligned slots 58, 68 and the aperture 76 of the rectangular blade 74, and engages the knurled nut 72 to secure the blade on the lower end of the handle assembly. The upper edge 74' of the blade bears upon the undersides of three teeth 66 to maintain blade position; the teeth 66 project from the clamping piece 62, and seat in the cavity 56 of the arm 38. Like the supporting arm 38, the clamping piece 62 has a V-shaped lower edge 77 with a beveled marginal portion 78, thus cooperating with the lower portion of the supporting arm to permit the corner portions 74" of the blade 74 to protrude beyond the lower boundaries of the head assembly for cutting without obstruction; this is best seen in FIG. 7. The aligned slots 58, 68 permit limited shifting of the blade 74 across the head, and thereby enable ready variation of the depth of cutting, as indicated by the indicia provided.

The indicia constitute series of marks 79, equidistantly spaced from one another on the marginal portion 78 and along the rectilinear elements of the edge 77 that defines the lower boundary of the assembly. Needless to say, the greater the extent of protrusion of the operative blade element 74" the greater will be the depth of penetration into the workpiece. This blade-shifting feature is believed to afford particular advantage in the form of cutter described and claimed herein.

With the head pivoted counterclockwise, as shown in FIG. 1, cutting of the workpiece S would occur with the cutter moving in the direction indicated by the arrow. The head would of course be pivoted clockwise to cut in the opposite direction. In both cases the operative blade portion 74" penetrates the underlying sheet material S in a plunging action.

Figure 8:
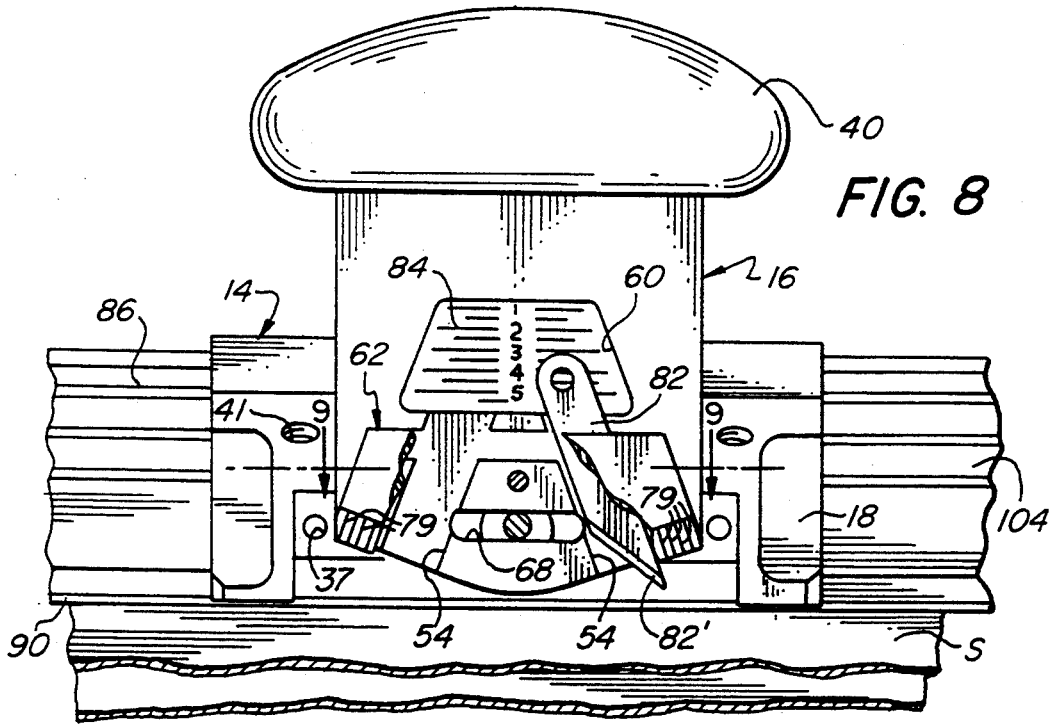
FIG. 8 is a view similar to FIG. 7, in which is utilized a second form of blade and in which a section of the clamping piece is broken away to show underlying features.

FIG. 8 shows the cutter used with a second form of blade 82, which is fabricated from an elongate piece of flat metal, sharpened as at 82' (a so-called "Dexter #3" blade). It will be appreciated however that the accommodation of such blades is optional, and constitutes no part of the invention. The blade 82 is secured within one of the passages formed by the cooperating channels 54, 64, and is so positioned that the point of its sharpened edge 82' protrudes slightly beyond the lower boundary of the head. As will be self evident, the blade 82 is brought into operative position by pivoting the handle member in a clockwise direction (as the cutter is depicted in FIG. 8), again causing the point of the blade to penetrate the workpiece in a plunging manner. To cut in the opposite direction a blade 82 would of course be secured in the other passage, in mirror-image relationship.

FIG. 8 (among others) also shows a depth-indicating scale insert 84 affixed within the shallow recess 60, as may be provided by a pressure-sensitive adhesive-coated label; alternatively, appropriate scale markings may be of molded fabrication. Alignment of the curved upper end of the blade 82 with a selected graduation mark will enable a desired depth of cut to be readily replicated.

Figure 9:
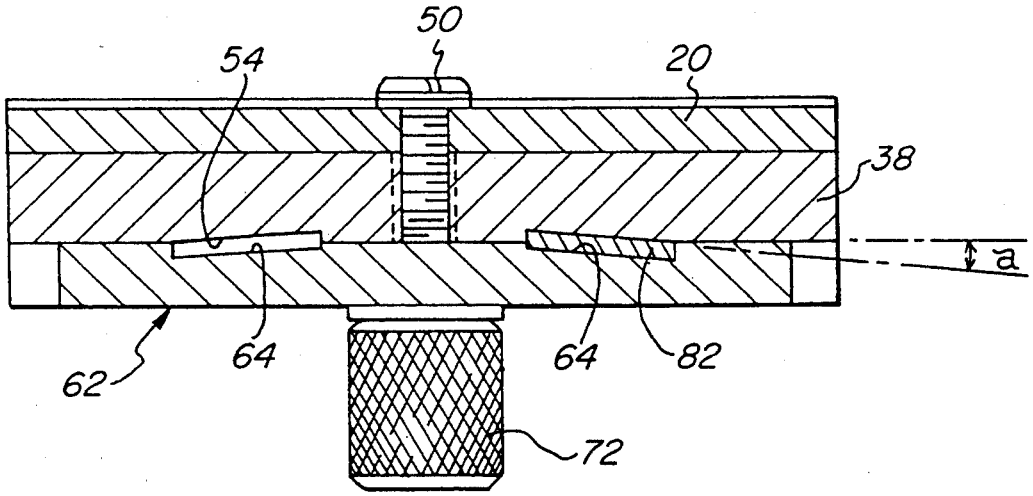
FIG. 9 is a sectional view taken along line 9—9 of FIG. 8 and drawn to an enlarged scale.

As seen in FIG. 9, the blade 82 is secured by the cutting head at a slight angle "a" to the travel path axis. The angle will normally have a value of 1° to 2° as is known to be desirable from the standpoint of counteracting the tendency that the blade would otherwise have to wander from the intended cut line, and thereby to produce less than ideal precision.

Figure 10:
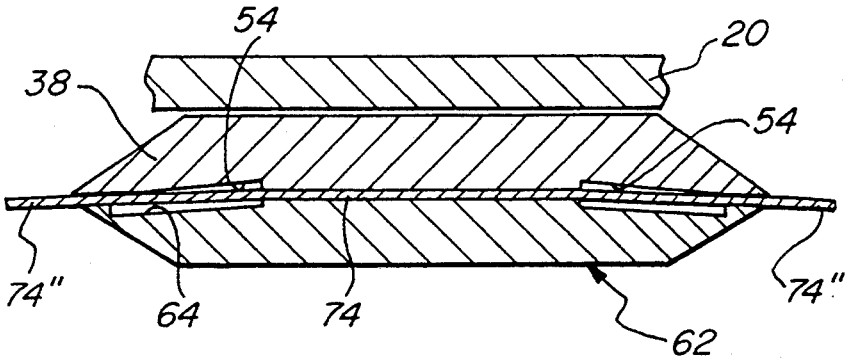
FIG. 10 is a sectional view taken along line 10—10 of FIG. 7 and drawn to an enlarged scale.

The feature depicted in FIG. 10 achieves essentially the same purpose in those instances in which a rectangular blade 74, or another, comparably shaped (e.g., trapezoidal) blade, is employed to provide the two protruding blade elements. Thus, the outwardly directed face of the arm 38 and the inwardly directed face of the clamping piece 62 are concavely and convexly contoured, respectively, to the same, large-radius value. Clamping of the blade 74 between the cooperating components will therefore cause its protruding corner portions 74'' to be angled slightly (i.e., typically at 1° to 2°) with reference to the line of cutting, effective in both directions as well as inversions of the head. Such deformation will also produce a desirable stiffening of the blade 74.

The cutting head illustrated is designed for use with a workpiece clamping member, such as the assembly 12 hereinabove referred to with reference to FIG. 1. Since that Figure only fragmentarily shows the system, it should be pointed out that the opposite ends of the workpiece-supporting base 10, as well as of the clamping bar assembly 12, will be of substantially identical construction.

The clamping bar assembly 12 consists of an elongate extrusion (normally of aluminum) which is, as best seen in FIG. 6, symmetrical about a longitudinal plane through the center line, the plane being vertical in the position of normal use. The extrusion is formed with an elevated track or central portion 86 of generally rectangular cross section, below and from the opposite sides of which extend outwardly tapering shoulder portions 88, terminating in flat marginal portions 90 which provide running surfaces 91 upon which ride the bearing surfaces 28 and 30 of the base 14 when the cutter is assembled therewith. The profile of the upper portion of the extrusion conforms in male/female relationship to that of the bottom portion of the cutter base 14, thus permitting slidable seating of the cutter on the clamping bar; the symmetry of the mating parts, about a vertical plane through the channel and track, enables end-for-end inversion of the cutter for ambidextrous use.

The underlying surfaces 92 of the shoulders 88 are flat and coplanar, being thus adapted for holding the sheet material S flat against the top surface of the board 94 of which the workpiece-supporting base assembly 10 is comprised. A shallow slot 96 extends along the inner margin on the underside of each flange 88, in one of which is shown a rubber element 98 for better restraint of the sheet S against shifting under the clamping bar; elements 98 seated in both slots 96 will generally afford optimal balance. Formed into the top surface of the elevated portion 86 of the bar is a shallow recess 100, in which is received a scale-bearing insert 102; as seen in FIG. 1, the insert 102 includes both metric and English system linear distance scales. The elevated portion 86 also As best seen in FIG. 2, an L-shaped extrusion 154 is attached as a mat guide to the front edge of the board 94 by screws 156 received in vertical slots 158. This arrangement permits shifting of the extrusion 154 across the thickness of the board 94, to lower the abutment edge presented and thereby facilitate extension of the sheet material S thereover, for convenient downsizing.

The cutter can be used in various ways; e.g., seated on the track of the clamping bar assembly, run on the surfaces 29 along the edge of the clamping bar or a separate straightedge member or, indeed, in a free-hand mode. The structure of the base permits 180° inversion of the cutter; not only does this enable ambidextrous use, as previously mentioned, but moreover, by disposing the blade most remotely to the mat guide it permits cutting of margins that correspond to virtually the full width of the base (typically about 20 centimeters). It will be appreciated that a protective underlayment mat will normally be employed beneath the workpiece, and that numerous modifications may be made to the cutter described, and its components, without departure from the novel concepts hereof or from the scope of the claims appended hereto.

Features shown in the drawings, but not mentioned or discussed herein, are more fully described in the above-identified parent application, now U.S. Pat. No. 5,269, 212 to which reference may be had if so desired.

Thus, it can be seen that the present invention provides a novel manual cutter that enables cutting of sheet material Thus, it can be seen that the present invention provides a novel manual cutter that enables cutting of sheet material workpieces in both of two opposite directions, that affords an advantageous degree of flexibility of use, and that is, at the same time, of relatively simple and inexpensive construction and hence well adapted for promotion and sale as a DIY cutter. The cutter affords a desirable plunging action for blade penetration, and it enables the depth of cutting to be readily and effectively adjusted.

Having thus described the invention, what is claimed is:

1. A cutter for cutting sheet material, comprising:

a base having an upstanding wall portion; and a cutting head including mounting structure having upper and lower opposite end portions with handle means on said upper end portion and blade-holding means on said lower end portion, said head being mounted on said wall portion for pivotal movement in opposite directions relative to a central axis of said wall portion extending through the axis of pivoting, and said blade-holding means having two edge elements spaced to the opposite sides of a longitudinal axis of said mounting structure extending endwise thereof through said axis of pivoting, each of said edge elements having a generally upward incline, taken with reference to said longitudinal axis, vertically oriented, and defining a portion of a lower boundary of said blade-holding means, said blade-holding means being constructed to secure at least a single blade on said head, to provide two operative blade elements for protrusion beyond each of said edge elements, and having blade-positioning indicia thereon extending along at least one of said edge elements, said blade-holding means including means for mounting such a single blade and for constraining it to displacement along a lateral axis transverse to said longitudinal axis of said mounting structure, such displacement varying the extent of protrusion of the blade elements beyond said edge elements, as indicated by reference to said indicia on said blade-holding means.

2. The cutter of claim 1 wherein said edge elements are substantially rectilinear.

3. The cutter of claim 2 wherein said blade-positioning indicia comprises a series of marks, equidistantly spaced from one another, along each of said edge elements.

4. The cutter of claim 1 wherein said lower boundary of said blade-holding means is symmetrical with reference to said longitudinal axis.

5. The cutter of claim 1 wherein said means for mounting comprises at least one slot formed in said blade-holding means and extending on said lateral axis, and wherein said cutter includes a member having a shaft extending through said slot and displaceable therealong.

6. The cutter of claim 1 wherein said mounting structure and said handle means of said cutting head are substantially symmetric, about said longitudinal axis of said mounting structure, taken in planes to which said axis of pivoting is normal.

7. The cutter of claim 1 wherein said blade-holding means comprises inner and outer parts that cooperate to clamp the blade therebetween, at least one of said parts having at least one element extending therefrom toward the other of said parts and effectively defining a laterally extending blade-abutment element at a location spaced upwardly from said lower boundary.

8. The cutter of claim 7 wherein said mounting structure comprises said inner part, wherein said parts are formed with aligned slots extending on said lateral axis, and wherein said cutter includes a fastener extending through, and displaceable along, said slots for securing said parts in clamping relationship.

* * * * *